US009179207B2

(12) United States Patent
Song

(10) Patent No.: US 9,179,207 B2
(45) Date of Patent: Nov. 3, 2015

(54) SPEAKER BOX

(71) Applicant: Wei Song, Shenzhen (CN)

(72) Inventor: Wei Song, Shenzhen (CN)

(73) Assignee: AAC Technologies Pte, Ltd., Singapore (SG)

( * ) Notice: Subject to any disclaimer, the term of this patent is extended or adjusted under 35 U.S.C. 154(b) by 0 days.

(21) Appl. No.: 14/520,620

(22) Filed: Oct. 22, 2014

(65) Prior Publication Data

US 2015/0110336 A1 Apr. 23, 2015

(30) Foreign Application Priority Data

Oct. 23, 2013 (CN) ..... 2013 2 0655856

(51) Int. Cl.
*H04R 1/02* (2006.01)
*H04R 1/28* (2006.01)

(52) U.S. Cl.
CPC ..... *H04R 1/025* (2013.01); *H04R 1/02* (2013.01); *H04R 1/026* (2013.01); *H04R 1/2807* (2013.01); *H04R 2201/02* (2013.01); *H04R 2499/11* (2013.01)

(58) Field of Classification Search
CPC ..... H04R 1/02; H04R 1/28; H04R 1/2803; H04R 1/2811; H04R 1/2815; H04R 1/2819; H04R 1/2826; H04R 1/026; H04R 1/2896; H04R 2499/11; H04R 1/021; H04R 1/025; H04R 1/2807; H04R 1/345; H04R 9/06; H04R 2201/02
USPC ..... 381/87, 332, 334, 345, 349, 351, 386, 381/395, 412, 335, 388, 396; 181/155, 156, 181/199
See application file for complete search history.

(56) References Cited

U.S. PATENT DOCUMENTS

2009/0304221 A1* 12/2009 Lin ..... 381/386
2012/0008810 A1* 1/2012 Lu et al. ..... 381/332
2014/0023224 A1* 1/2014 Tao ..... 381/412

* cited by examiner

*Primary Examiner* — Huyen D Le
(74) *Attorney, Agent, or Firm* — IPro, Inc.; Na Xu

(57) ABSTRACT

A speaker box is disclosed. The speaker box includes a housing and a speaker unit. The housing includes a bottom, a side connected with the bottom, and a rear volume formed by the side and the bottom, the side including a first side and a second side connecting with the first side. The speaker unit includes a frame, a magnetic circuit unit accommodated in the frame, a vibration unit positioned above the magnetic circuit unit and fixed to the frame, and a front volume. The frame includes a first sidewall abutting against the first side, and a second sidewall connecting with the first sidewall. The first side includes a first mounting portion, the first sidewall includes a second mounting portion engaging with the first mounting portion.

9 Claims, 6 Drawing Sheets

A-A

B-B

SPEAKER BOX

FIELD OF THE INVENTION

The present invention relates to sound generators, and more particularly to a speaker box used in an electronic device for converting electrical signals to audible sounds.

DESCRIPTION OF RELATED ART

Speaker boxes are widely used in many types of portable electronic devices, such as mobile phones, notebook computers, and hearing aids, for converting audio electrical signals to audible sounds. A speaker box can improve the low frequency sound quality as the speaker box provides a sufficient resonant space therein.

Related speaker box includes two types, one of which is insert-type, and another of which is integrated-type. The insert-type speaker box generally includes a speaker unit surrounded and protected by a housing. The speaker unit includes a frame, a magnetic circuit unit accommodated in the frame, and a vibration unit positioned to the frame. The frame comprises sidewalls. For obtaining greater resonant space, the housing completely surrounds the frame. The insert-type speaker box has the advantages of convenient assembly, low cost, and great mass production efficiency. However, this type of speaker box has a width equal to a summation of the width of the frame and the width of the housing, which makes the speaker box too big.

For reducing the volume of the insert-type speaker box, the integrated-type speaker is developed by AAC Technologies Holdings Inc. The integrated speaker box includes a housing, a magnetic circuit unit accommodated in the housing, and a vibration unit positioned to the housing. The magnetic circuit unit and the vibration unit are both integrated with the housing. The frame used in the insert-type speaker box is accordingly omitted, which reduces the volume of the speaker box. However, it is more complicate to assemble the speaker box and the cost is thus increased.

Accordingly, an improved speaker box which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

Figure 1:
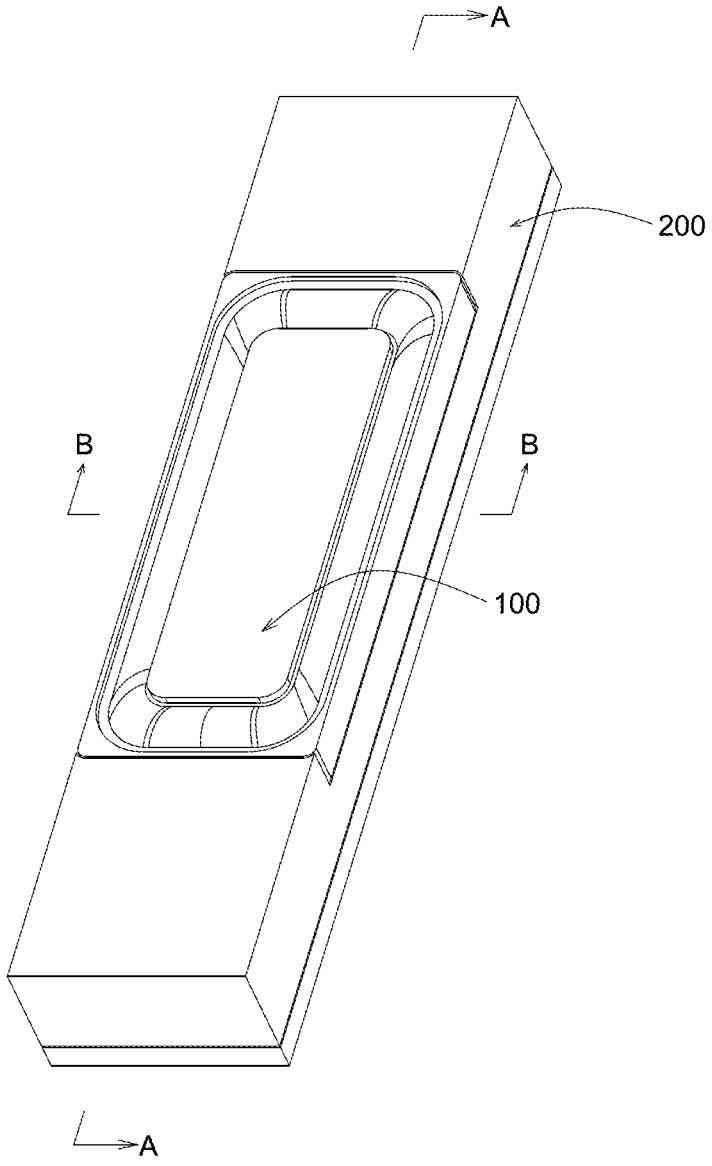
FIG. 1 is an isometric view of a speaker box in accordance with an exemplary embodiment of the present disclosure.
Figure 2:
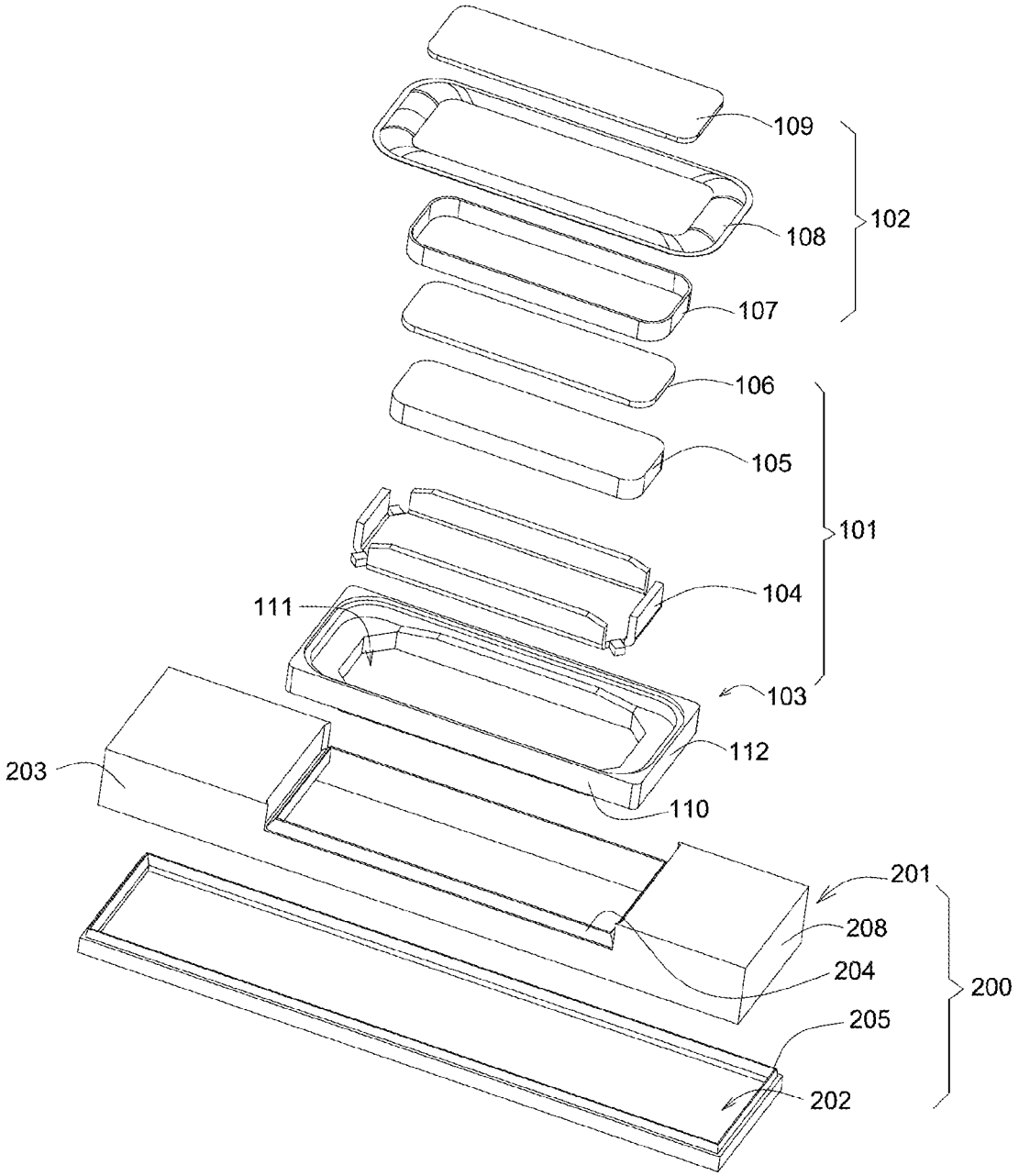
FIG. 2 is an isometric exploded view of the speaker box in FIG. 1.

Referring to FIGS. 1-2, a speaker box in accordance with an exemplary embodiment of the present disclosure includes a housing 200, and a speaker unit 100 coupled to the housing 200. The speaker unit 100 includes a frame 103, a magnetic circuit unit 101 accommodated in the frame 103, a vibration unit 102 arranged above the magnetic circuit unit 101 and positioned to the frame 103, and a front volume 113 formed by the vibration unit 102, the frame 103 and the magnetic circuit unit 101 (referring to FIG. 3). The magnetic circuit unit 101 includes a yoke 104, a magnet 105 coupled to the yoke 104, a pole plate 106 attached to a top of the magnet 105, and a magnetic gap. The vibration unit 102 includes a suspension 108, a dome 109 positioned at a center of the suspension 108, and a voice coil 107 with one end thereof connected to a lower surface of the suspension 108 and another end thereof suspended in the magnetic gap of the magnetic circuit unit 101. The frame of the speaker unit 100 has a first sidewall 110 and a second sidewall 112 connected with the first sidewall 110.

Figure 3:
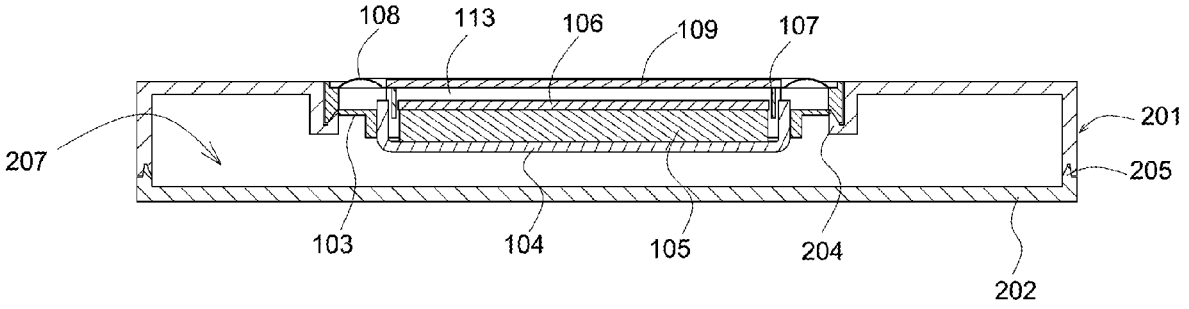
FIG. 3 is a cross-sectional view of the speaker box taken along line A-A in FIG. 1.
Figure 4:
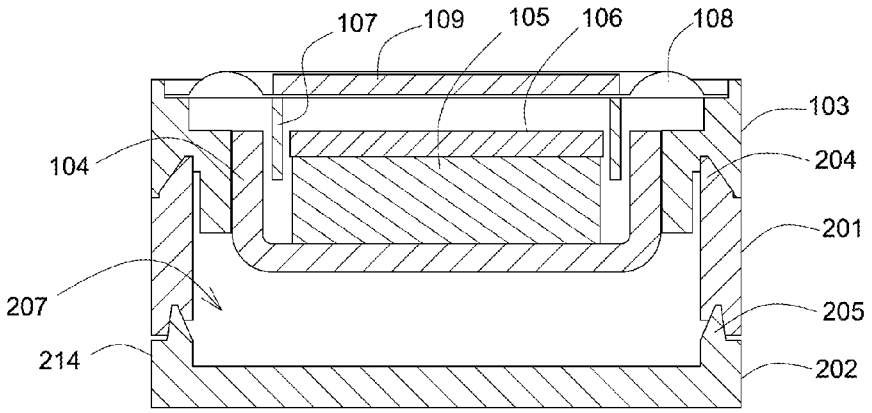
FIG. 4 is a cross-sectional view of the speaker box taken along line B-B in FIG. 1.

The housing 200 includes a bottom 202, a side connected with the bottom 202, and a rear volume formed by the bottom 202 and the side (referring to FIGS. 3-4). The rear volume 207 communicates with the front volume 113. The existence of the rear volume 207 improves the acoustic performance of the speaker box. Further, the side includes a first side 203 and a second side 208 connected to the first side 203. The first side 203 includes a first mounting portion 204 extending away from the bottom 202, and accordingly, the first sidewall 110 of the frame 103 includes a second mounting portion 114 (referring to FIG. 7) corresponding to the first mounting portion 204. In addition, an exterior surface of the first sidewall 110 is coplanar with an exterior surface of the first side 203. The exterior surfaces of the first sidewall 110 and the first side 203 make a total width of the speaker box equal to a width of the frame, which sufficiently makes use of the most outline of the speaker box, and improves the acoustic performance (low frequency sound quality) of the speaker box.

Figure 5:
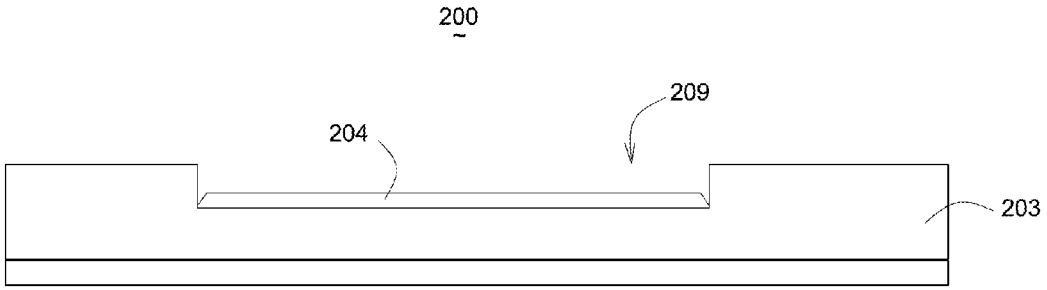
FIG. 5 is a side view of a housing of the speaker box.

As an optional configuration of the present disclosure, referring to FIG. 5, the first side 203 includes a recess 209 adjacent to the bottom 202, and the first mounting portion 204 is mounted in the recess 209. An interior surface of the second side 208 abuts against an exterior surface of the second sidewall. As an improvement of the second side 208, the second side 208 includes a first side unit connected with two ends of the first side 203, and a second side unit connected with the first side unit. Structure of the second side unit is substantially same to the first side 203, i.e., the second side unit also includes a recess at the corresponding position, and in the recess another first mounting portion is also provided.

Figure 6:
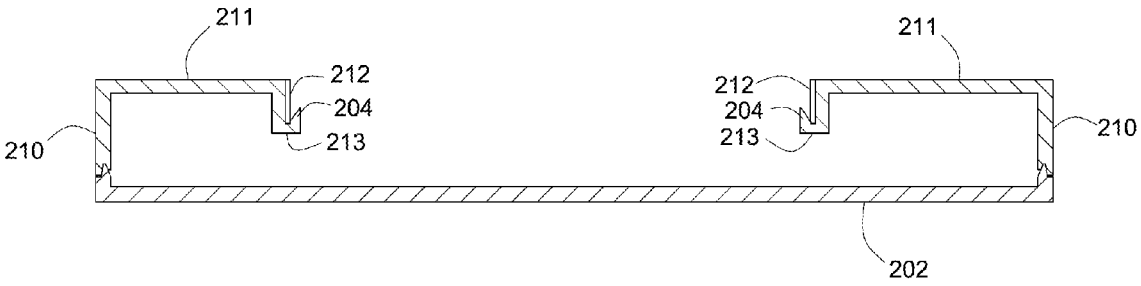
FIG. 6 is a cross-sectional view of the housing in FIG. 5.

Optionally, referring to FIG. 6, the first side unit includes a first extending portion 210 extending bendly from the bottom 202, a second extending portion 211 extending from the first extending portion 210, a third extending portion 212 extending from the second extending portion 211 toward the bottom 202, and a fourth extending portion 213 extending from the third extending portion 212. The first mounting portion 204 also couples to the fourth extending portion 213. At the same time, the second sidewall 112 of the frame 103 corresponding to the fourth extending portion 213 provides the second mounting portion 114.

Figure 9:
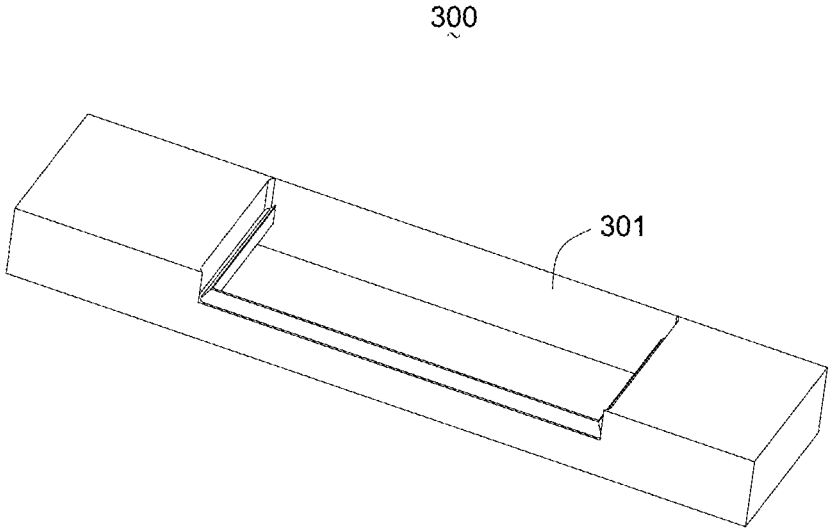
FIG. 9 is an illustrative view of a first other type of housing of the speaker box.
Figure 10:
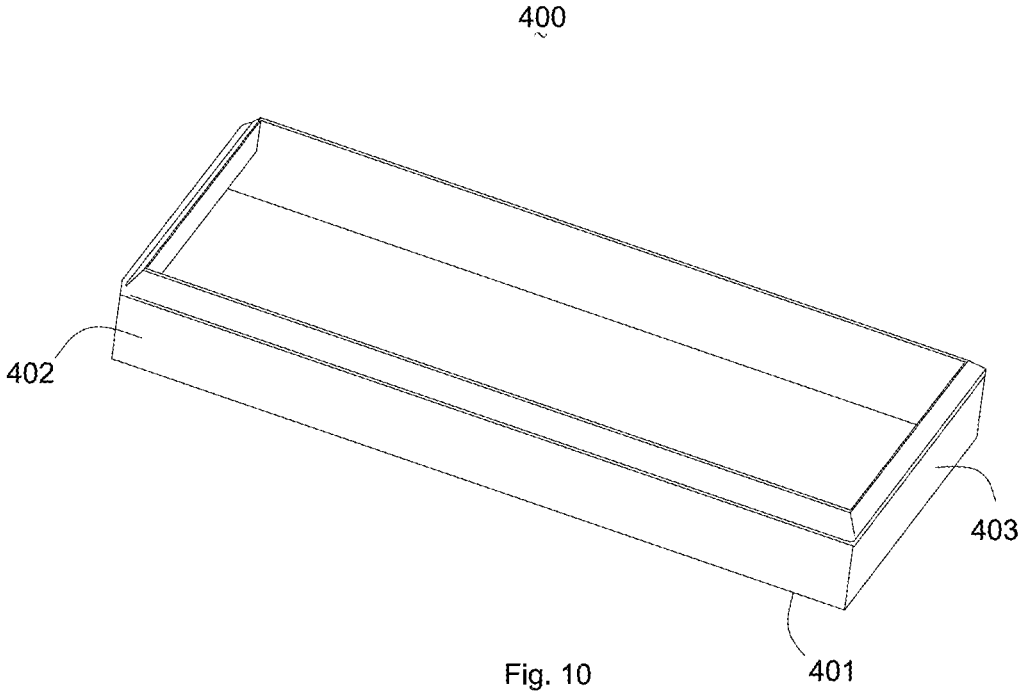
FIG. 10 is an illustrative view of a second other type of housing of the speaker box.

It is noted that the second side unit may have a structure different from the first side. Referring to the housing 300 shown in FIG. 9, the second side unit 301 provides no recess and no first mounting portion. Referring to the housing 400 shown in FIG. 10, the housing 400 includes a bottom 401 and a side forming a rear volume cooperatively with the bottom 401. The side further includes a first side 402 and a second side 403 opposed to the first side 402. One of the first and second sides 402, 403 is provided with a first mounting portion. In FIG. 10, each of the two sides is provided with a first mounting portion.

Figure 7:
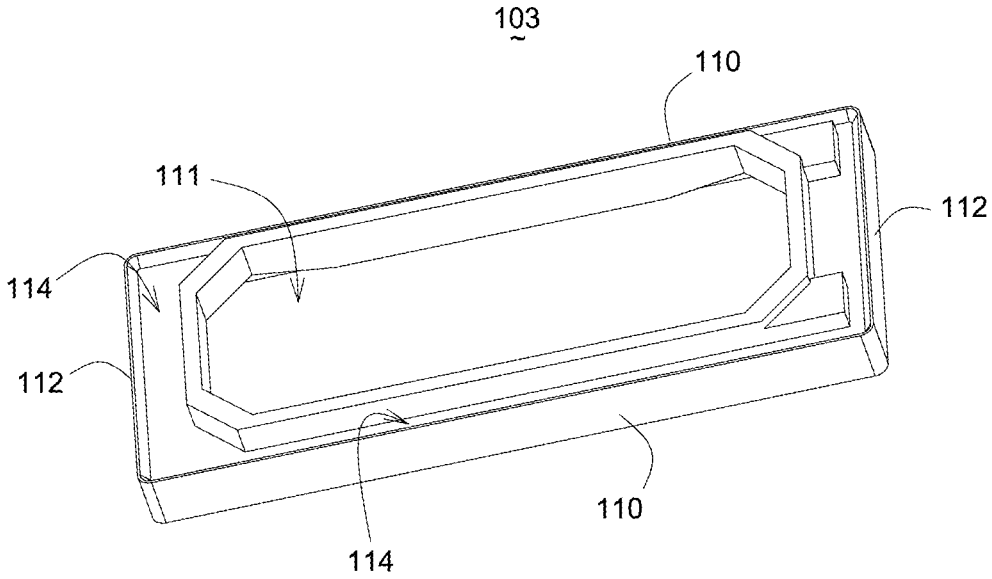
FIG. 7 is an isometric view of a frame of the speaker box.

In the embodiment, the first mounting portion 204 and the second mounting portion 114 are complementary to each other. For example, when the first mounting portion 204 is a protrusion extending from the first side 203, the second mounting portion 114 is a concavity formed in the first sidewall 110 corresponding to the protrusion, i.e., the first mounting portion 204 (as shown in FIG. 7).

Figure 8:
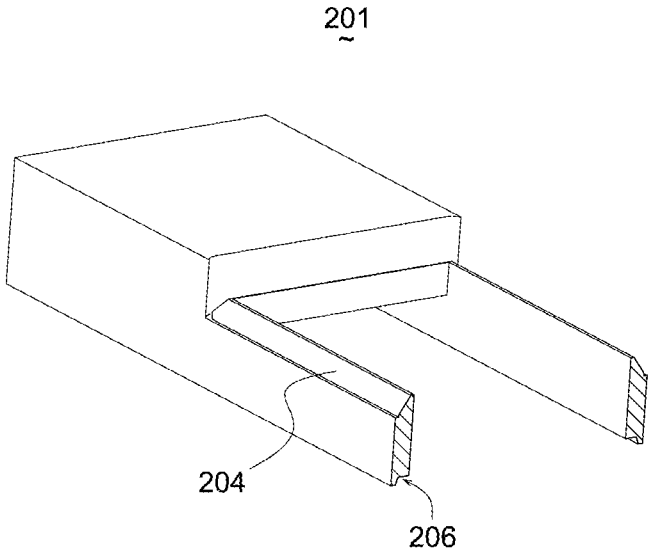
FIG. 8 is a broken view if an upper case of the speaker box.

The bottom 202 includes a protruded side 214 (referring to FIG. 4) for engaging with the side of the housing 200. The protruded side 214 includes a convexity 205 extending away from the bottom 202, and the side includes a concavity 206 corresponding to the convexity 205 (referring to FIG. 8).

The first mounting portion of the housing and the second mounting potion of the frame make it convenient to assemble the speaker box. And the housing does not completely surround the speaker unit, which sufficiently makes use of the most outline of the speaker box, and improves the acoustic performance (low frequency sound quality) of the speaker box.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker box, comprising:

a housing including a bottom, a side connected with the bottom, and a rear volume formed by the side and the bottom, the side including a first side and a second side connecting with the first side;

a speaker unit coupled with the housing, including a frame, a magnetic circuit unit accommodated in the frame, a vibration unit positioned above the magnetic circuit unit and fixed to the frame, and a front volume formed by the vibration unit, the frame and the magnetic circuit unit, the front volume being communicated with the rear volume; wherein the frame includes a first sidewall abutting against the first side, and a second sidewall connecting with the first sidewall, the first side includes a first mounting portion extending away from the bottom, the first sidewall includes a second mounting portion engaging with the first mounting portion, and an exterior surface of the first sidewall is coplanar with an exterior surface of the first side, and wherein the first side includes a recess for cooperating with the first mounting portion, and an exterior surface of the second sidewall abuts against an interior surface of the second side.

2. The speaker box as claimed in claim 1, wherein the second side includes a first side unit connected with two ends of the first side, and a second side unit connected to the first side unit.

3. The speaker box as claimed in claim 2, wherein the first side unit includes a first extending portion extending bendly from the bottom, a second extending portion extending from the first extending portion, a third extending portion extending from the second extending portion toward the bottom, and a fourth extending portion extending from the third extending portion.

4. The speaker box as claimed in claim 3, wherein the second sidewall abuts against the third extending portion.

5. The speaker box as claimed in claim 2, wherein the fourth extending portion also includes the first mounting portion, and the frame also includes the second mounting portion for engaging with the first mounting portion of the fourth extending portion.

6. The speaker box as claimed in claim 1, wherein the first mounting portion is complementary to the second mounting portion.

7. The speaker box as claimed in claim 6, wherein the first mounting portion is a protrusion extending from the first side, the second mounting portion is a concavity formed in the first sidewall corresponding to the protrusion.

8. The speaker box as claimed in claim 1, wherein the bottom includes a protruded side for engaging with the side of the housing.

9. The speaker box as claimed in claim 8, wherein the protruded side includes a convexity extending away from the bottom, and the side includes a concavity corresponding to the convexity.

* * * * *